US010531688B2

(12) United States Patent
Oishi

(10) Patent No.: US 10,531,688 B2
(45) Date of Patent: Jan. 14, 2020

(54) NON-BURNING TYPE FLAVOR INHALER

(71) Applicant: JAPAN TOBACCO INC., Tokyo (JP)

(72) Inventor: Kei Oishi, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 155 days.

(21) Appl. No.: 15/687,246

(22) Filed: Aug. 25, 2017

(65) Prior Publication Data

US 2017/0347704 A1 Dec. 7, 2017

Related U.S. Application Data

(63) Continuation of application No. PCT/JP2015/055908, filed on Feb. 27, 2015.

(51) Int. Cl.
*A24F 47/00* (2006.01)

(52) U.S. Cl.
CPC ..... *A24F 47/008* (2013.01); *A24F 47/002* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 5,372,148 | A | 12/1994 | McCafferty et al. | |
| 9,955,728 | B2 * | 5/2018 | Liu | A24F 47/008 |
| 2011/0036346 | A1 | 2/2011 | Cohen et al. | |
| 2012/0048266 | A1 | 3/2012 | Alelov | |
| 2013/0042865 | A1 | 2/2013 | Monsees et al. | |
| 2013/0319440 | A1 | 12/2013 | Capuano | |
| 2013/0340775 | A1 | 12/2013 | Juster et al. | |
| 2014/0123990 | A1 | 5/2014 | Timmermans | |
| 2017/0238608 | A1 * | 8/2017 | Matsumoto | A24F 47/00 |
| 2017/0347704 | A1 * | 12/2017 | Oishi | A24F 47/002 |
| 2018/0007960 | A1 * | 1/2018 | Suzuki | A24F 47/00 |
| 2018/0049477 | A1 * | 2/2018 | Suzuki | A24F 47/00 |
| 2018/0078718 | A1 * | 3/2018 | Suzuki | A24F 47/00 |

(Continued)

FOREIGN PATENT DOCUMENTS

| | | | |
|---|---|---|---|
| EP | 0430559 | A2 | 5/1991 |
| GB | 2507103 | A | 4/2014 |
| JP | 3696619 | B2 | 9/2005 |

(Continued)

OTHER PUBLICATIONS

International Search Report for PCT/JP2015/055908 (PCT/ISA/210) dated May 26, 2015.

(Continued)

*Primary Examiner* — James Harvey
(74) *Attorney, Agent, or Firm* — Birch, Stewart, Kolasch & Birch, LLP

(57) ABSTRACT

This non-combusting flavor inhaler is provided with: an atomization unit that is configured to atomize an aerosol source without entailing combustion; a power source that stores power that is supplied to the atomization unit; and a control unit that is configured to control power supply to the atomization unit using a mode selected from among a plurality of modes. The plurality of modes include a plurality of operation modes for generating an aerosol from the atomization unit, and a restriction mode for restricting driving of the atomization unit, said mode being decided separately from the plurality of operation modes.

8 Claims, 6 Drawing Sheets

(56) References Cited

U.S. PATENT DOCUMENTS

2018/0146715 A1* 5/2018 Takeuchi ..... A24F 47/00

FOREIGN PATENT DOCUMENTS

| | | | |
|---|---|---|---|
| JP | 2014-504886 | A | 2/2014 |
| JP | 2014-524313 | A | 9/2014 |
| KR | 20-0464889 | Y1 | 2/2013 |
| KR | 10-2013-0127412 | A | 11/2013 |
| KR | 10-1755591 | B1 | 7/2017 |
| WO | WO 2014/072824 | A2 | 5/2014 |
| WO | WO 2014/205263 | A1 | 12/2014 |

OTHER PUBLICATIONS

Japanese Office Action and English translation dated Feb. 27, 2018 for Application No. 2017-501805.
Extended European Search Report for European Application No. 15883253.5, dated Aug. 29, 2018.
Korean Notification of Reason for Refusal for Korean Application No. 10-2017-7023380, dated Aug. 22, 2018, with English translation.
Japanese Office Action, dated Oct. 2, 2018, for Japanese Application No. 2017-501805, with an English translation.
Australian Office Action, dated Jul. 12, 2018, for Australian Application No. 2015384410.
Korean Office Action, dated Feb. 27, 2019, for Korean Application No. 10-2017-7023380, along with an English machine translation.

* cited by examiner

NON-BURNING TYPE FLAVOR INHALER

CROSS REFERENCE TO RELATED APPLICATIONS

This application is a Continuation of PCT International Application No. PCT/JP2015/055908, filed on Feb. 27, 2015, which is hereby expressly incorporated by reference into the present application.

TECHNICAL FIELD

The present invention relates to a non-burning type flavor inhaler having an atomizer configured to atomize an aerosol source without burning.

BACKGROUND ART

Known is a non-burning type flavor inhaler having an atomizer configured to atomize an aerosol source without burning. Proposed, as such a non-burning type flavor inhaler, is a non-burning type flavor inhaler in which a user switches the amount of aerosol generated from the atomizer (Patent Document 1).

PRIOR ART DOCUMENT

Patent Document

Patent Document 1: US2014/0123990A

SUMMARY OF THE INVENTION

A first feature is summarized as a non-burning type flavor inhaler comprising: an atomizer configured to atomize an aerosol source without burning; a power source configured to accumulate power to be supplied to the atomizer; and a controller configured to control a power supply to the atomizer in a mode selected from among a plurality of modes, wherein the plurality of modes include a plurality of operation modes that the atomizer generates an aerosol, and a restriction mode that restricting drive of the atomizer and defined separately from the plurality of operation modes.

A second feature according to the first feature is summarized as that the plurality of operation modes are switched in an order in accordance with a predetermined switching order, and an index indicating an amount of the aerosol generated from the atomizer has a difference of a certain value or more from each other between two operation modes adjacent in the predetermined switching order.

A third feature according to the second feature is summarized as that the index is a total amount of aerosol generated from the atomizer in a puff action series which is a series of puff actions repeated by a predetermined number, and the total amount of aerosol has a difference of 2.0 mg or more from each other between two operation modes adjacent in the switching order, the index is a standard amount of aerosol generated from the atomizer in a single puff action, and the standard amount of aerosol has a difference of 0.3 mg or more from each other between two operation modes adjacent in the switching order, or the index is an aerosol amount per unit time generated from the atomizer in a unit time, and the aerosol amount per unit time has a difference of 0.15 mg/sec. or more from each other between two operation modes adjacent in the switching order.

A fourth feature according to the second feature is summarized as that the index is a total amount of aerosol generated from the atomizer in a puff action series which is a series of puff actions repeated by a predetermined number, and the total amount of aerosol has a difference of 2.0 mg or more from each other between two operation modes adjacent in the switching order.

A fifth feature according to the second feature is summarized as that the index is a standard amount of aerosol generated from the atomizer in a single puff action, and the standard amount of aerosol has a difference of 0.3 mg or more from each other between two operation modes adjacent in the switching order.

A sixth feature according to the second feature is summarized as that the index is an aerosol amount per unit time generated from the atomizer in a unit time, and the aerosol amount per unit time has a difference of 0.15 mg/sec. or more from each other between two operation modes adjacent in the switching order.

A seventh feature according to any one of the first feature to the sixth feature is summarized as the non-burning type flavor inhaler comprising: a light emitting element configured to emit light in a mode selection state, wherein the mode selection state is an instantaneous state at a timing of mode switching from one mode to another mode, or a state from the timing until a certain period has elapsed, and a light emitting state of the light emitting element in the mode selection state is different from a light emitting state of the light emitting element immediately before the timing.

An eighth feature according to any one of the first feature to the sixth feature is summarized as the non-burning type flavor inhaler comprising: a light emitting element configured to emit light in at least any one of a mode selection state, a puffing state, and a non-puffing state, wherein a light emitting state of the light emitting element includes a first puff light emitting state in the plurality of operation modes, and a second puff light emitting state in the restriction mode, the second puff light emitting state is different from the first puff light emitting state, the mode selection state is an instantaneous state at a timing of mode switching from one mode to another mode, or a state from the timing until a certain period has elapsed, the puffing state is a state in which a puff action is performed, and the non-puffing state is a state in which a puff action is not performed.

A ninth feature according to the seventh feature of the eighth feature is summarized as that a color temperature of the light emitting state of the light emitting element is 5500 K or less in each mode.

A tenth feature according to the ninth feature is summarized as that the light emitting state of the light emitting element in the plurality of modes is different by 200 K or more from each other.

An eleventh feature according to the seventh feature of the eighth feature is summarized as that a* is a positive value in the Lab color space in the light emitting state of the light emitting element.

A twelfth feature according to the eleventh feature is summarized as that color difference ΔE*ab of the light emitting state of the light emitting element in the plurality of modes is different by 3.0 or more from each other.

A thirteenth feature according to any one of the first feature to the twelfth feature is summarized as the non-burning type flavor inhaler comprising: an operation interface configured to switch a mode for controlling the power supply to the atomizer by a user operation, wherein the operation interface is constituted by a push button, and the user operation is pressing the push button.

A fourteenth feature according to any one of the first feature to the twelfth feature is summarized as the non-burning type flavor inhaler comprising: an operation interface configured to switch a mode for controlling the power supply to the atomizer by a user operation, wherein the operation interface is constituted by a ring member, and the user operation is rotating the ring member.

A fifteenth feature according to any one of the first feature to the fourteenth feature is summarized as that the controller does not supply power to the atomizer from a timing of selecting any mode from the plurality of modes until the lapse of a certain period, but supplies power to the atomizer after the lapse of the certain period.

A sixteenth feature according to any one of the first feature to the fifteenth feature is summarized as the non-burning type flavor inhaler comprising: a connector configured to connect an electrical unit having the power source and an atomizing unit having the atomizer, wherein the connector constitutes a means that switches a mode for controlling the power supply to the atomizer.

A seventeenth feature according to any one of the first feature to the sixteenth feature is summarized as the non-burning type flavor inhaler comprising: a sensor configured to output a response value that changes in accordance with air inhaled from a non-mouthpiece end toward a mouthpiece end, wherein the controller identifies whether or not a puff action is performed based on the response value.

DESCRIPTION OF THE EMBODIMENT

Figure 1:
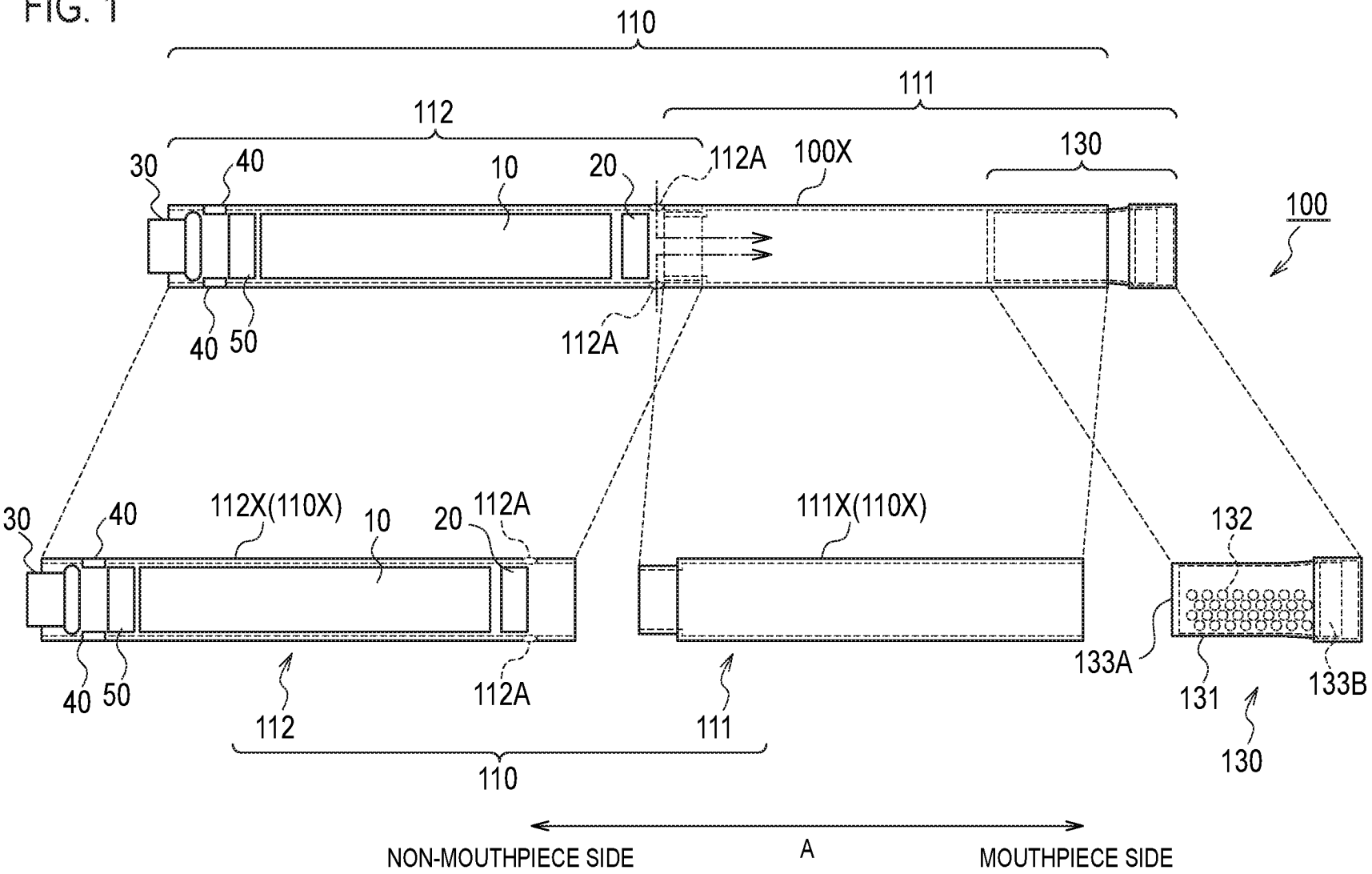
FIG. 1 is a diagram illustrating a non-burning type flavor inhaler 100 according to a first embodiment.

Hereinafter, embodiments of the present invention will be described. In the following description of the drawings, the same or similar reference numerals denote the same or similar parts. It should be noted that the drawings are schematic, and the ratios of dimensions and the like may be different from the actual ones.

Therefore, specific dimensions and the like may be determined by referring to the following description. Of course, the drawings may include the parts having different dimensions and ratios.

[Overview of Disclosure]

In the non-burning type flavor inhaler mentioned in the Background Art, while a user is capable of switching an amount of aerosol generated from the atomizer, the user mainly determines, by a sense of taste, whether or not such switching (mode switching) is actually functioning, i.e., presence or absence of a change in the amount of aerosol. Accordingly, it may be difficult for the user to confirm such a change.

A non-burning type flavor inhaler according to the embodiment comprises: an atomizer configured to atomize an aerosol source without burning; a power source configured to accumulate power to be supplied to the atomizer; and a controller configured to control a power supply to the atomizer in a mode selected from among a plurality of modes. The plurality of modes include a plurality of operation modes that the atomizer generates an aerosol, and a restriction mode that restricting drive of the atomizer and defined separately from the plurality of operation modes.

According to the embodiment, in addition to the plurality of operation modes, the plurality of modes include a restriction mode for restricting the drive of the atomizer. Therefore, by switching the mode for controlling the power supply to the atomizer to the restriction mode, the user is capable of clearly perceiving a reduction in the aerosol. Therefore, the user is capable of easily understanding whether or not switching (switching of the mode) of the amount of the aerosol generated from the atomizer is actually functioning.

Here, the restriction mode may be a mode for restricting the drive of the atomizer. Therefore, the restriction mode may be a mode for stopping the power supply to the atomizer. Alternatively, the restriction mode may be a mode in which power is supplied to the atomizer, but the amount of power supplied to the atomizer in the restriction mode is preferably a value (a value at which an aerosol amount smaller than the level perceived by the user is generated) smaller than a predetermined value.

However, it should be noted that the restriction mode is not a state in which the power source of the entire non-burning type flavor inhaler is disconnected. For example, in the restriction mode, the power supply to the control circuit or the like continues (the control circuit is in an energizing state).

First Embodiment (Non-Burning Type Flavor Inhaler)

Figure 2:
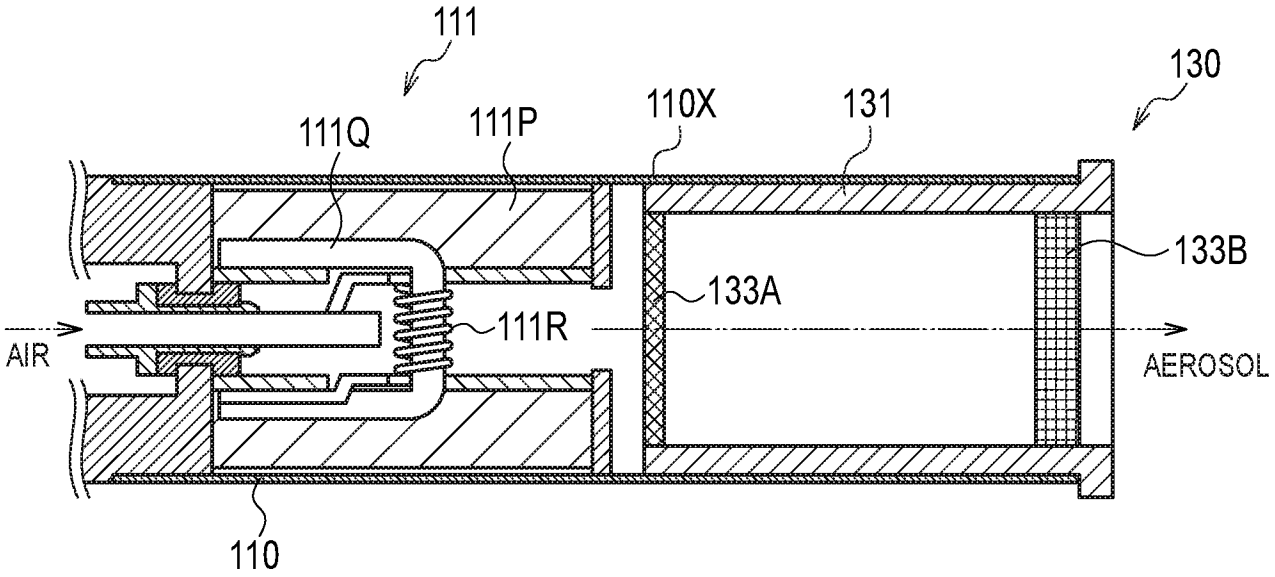
FIG. 2 is a diagram illustrating an atomizing unit 111 according to the first embodiment.

A non-burning type flavor inhaler according to a first embodiment will be described, below. FIG. 1 is a diagram illustrating a non-burning type flavor inhaler 100 according to the first embodiment. The non-burning type flavor inhaler 100 is a device configured to be used to inhale an inhaling flavor component without burning, and has a shape extending in a predetermined direction A that is a direction from a non-mouthpiece end toward a mouthpiece end. FIG. 2 is a diagram illustrating an atomizing unit 111 according to the first embodiment. It should be noted that hereinafter, the non-burning type flavor inhaler 100 will be simply called a flavor inhaler 100.

As illustrated in FIG. 1, the flavor inhaler 100 has an inhaler main unit 110 and a cartridge 130.

The inhaler main unit 110 is included in a main unit of the flavor inhaler 100, and has a shape allowing the cartridge 130 to be connected. Specifically, the inhaler main unit 110 has a cylinder 110X, and the cartridge 130 is connected to the mouthpiece end of the cylinder 110X. The inhaler main unit 110 has an atomizing unit 111 and an electrical unit 112 configured to atomize an aerosol source without burning.

In the first embodiment, the atomizing unit 111 has a first cylinder 111X constituting a part of the cylinder 110X. As illustrated in FIG. 2, the atomizing unit 111 has a reservoir 111P, a wick 111Q, and an atomizer 111R. The reservoir 111P, the wick 111Q, and the atomizer 111R are housed in the first cylinder 111X. The reservoir 111P retains an aerosol source. For example, the reservoir 111P is a porous body constituted by a material such as a resin web. The wick 111Q is an example of an aerosol inhaling unit configured to absorb the aerosol source retained in the reservoir 111P. For example, the wick 111Q is constituted by a glass fiber. The atomizer 111R atomizes the aerosol source absorbed by the wick 111Q. The atomizer 111R is, for example, constituted by a heating resistor (for example, a heating wire) wound around the wick 111Q at a predetermined pitch.

The aerosol source is a liquid, such as glycerin or propylene glycol. The aerosol source is, for example, as described above, retained by a porous body constituted by a material such as a resin web. The porous body may be constituted by a non-tobacco material, or may be constituted by a tobacco material. It is noted that the aerosol source may include a flavor source containing a nicotine component or the like. Alternatively, the aerosol source need not include a flavor source containing a nicotine component or the like. The aerosol source may include a flavor source containing a component other than the nicotine component. Alternatively, the aerosol source need not include a flavor source containing a component other than the nicotine component.

In the first embodiment, a heating type unit configured to atomize the aerosol source by heating is illustrated as the atomizing unit 111. However, the atomizing unit 111 may be an ultrasonic wave type unit configured to atomize the aerosol source by ultrasonic waves.

The electrical unit 112 has a second cylinder 112X constituting a part of the cylinder 110X. In the first embodiment, the electrical unit 112 has an air hole 112A. As illustrated in FIG. 2, the air introduced from the air hole 112A is introduced into the atomizing unit 111 (the atomizer 111R). In particular, the electrical unit 112 has a power source 10, a sensor 20, a push button 30, a light emitting element 40, and a control circuit 50.

The power source 10 is, for example, a lithium ion battery. The power source 10 accumulates the power necessary for the operation of the non-burning type flavor inhaler 100. For example, the power source 10 accumulates the power supplied to the sensor 20, the light emitting element 40, and the control circuit 50. Moreover, the power source 10 accumulates the power supplied to the atomizing unit 111 (the atomizer 111R).

The sensor 20 outputs a response value that changes in accordance with air inhaled from the non-mouthpiece end toward the mouthpiece end (that is, a puff action of a user). The sensor 20 is, for example, a microphone sensor.

The push button 30 is configured to be pushed from the outer side of the non-burning type flavor inhaler 100 toward the inner side thereof. In the embodiment, the push button 30 is provided at the non-mouthpiece end of the non-burning type flavor inhaler 100, and is configured to be pushed in a direction from the non-mouthpiece end toward the mouthpiece end (that is, in the predetermined direction A). For example, when the push button 30 is pushed continuously over a predetermined number of times, the power source of the non-burning type flavor inhaler 100 is turned ON. It is noted that the power source of the non-burning type flavor inhaler 100 may be disconnected when a predetermined time elapses from a puff action being performed.

The light emitting element 40 is, for example, a light source such as an LED or an electric lamp. The light emitting element 40 is provided on a side wall extending along the predetermined direction A. The light emitting element 40 is preferably provided near the non-mouthpiece end. As a result, as compared to a case where the light emitting element is provided near the non-mouthpiece end on an axial line of the predetermined direction A, the user can visually and easily recognize the light-emitting pattern of the light emitting element 40 during the puff action. The light-emitting pattern of the light emitting element 40 is a pattern by which a condition of the non-burning type flavor inhaler 100 is notified to the user.

The control circuit 50 controls the operation of the non-burning type flavor inhaler 100. Specifically, the control circuit 50 controls the light-emitting pattern of the light emitting element 40, and also controls the power supplied to the atomizing unit 111 (the atomizer 111R).

The cartridge 130 is configured to be capable of connecting to the inhaler main unit 110 constituting the flavor inhaler 100. The cartridge 130 is provided toward the mouthpiece side from the atomizing unit 111 on a flow path of a gas (hereinafter, air) suctioned from the mouthpiece. In other words, the cartridge 130 need not always be provided, in terms of a physical space, toward the mouthpiece side from the atomizing unit 111, but may be provided toward the mouthpiece side from the atomizing unit 111 on an aerosol flow path for introducing, to the mouthpiece side, the aerosol generated by the atomizing unit 111. That is, in the first embodiment, the "mouthpiece side" may be considered synonymous with the "downstream" of the flow of the aerosol, and the "non-mouthpiece side" may be considered synonymous with the "upstream" of the flow of the aerosol.

Specifically, the cartridge 130 has a cartridge main unit 131, a flavor source 132, a mesh 133A, and a filter 133B.

The cartridge main unit 131 has a cylindrical shape extending along the predetermined direction A. The cartridge main unit 131 houses the flavor source 132.

The flavor source 132 is provided toward the mouthpiece side from the atomizing unit 111 on a flow path of air suctioned from the mouthpiece. The flavor source 132 imparts an inhaling flavor component to the aerosol generated from the aerosol source. In other words, the flavor imparted to the aerosol by the flavor source 132 is carried to the mouthpiece.

In the first embodiment, the flavor source 132 is constituted by raw material pieces that impart the inhaling flavor component to the aerosol generated from the atomizing unit 111. The size of the raw material pieces is preferably from 0.2 mm to 1.2 mm. Furthermore, the size of the raw material pieces is preferably from 0.2 mm to 0.7 mm. The smaller the size of the raw material pieces included in the flavor source 132, the more the specific surface area, therefore an inhaling flavor component is more easily released from the raw material pieces included in the flavor source 132. Therefore, the amount of raw material pieces can be controlled when imparting a desired amount of the inhaling flavor component to the aerosol. It is possible to use shredded tobacco or a formed body in which a tobacco raw material is granularly formed as the raw material pieces included in the flavor source 132. However, the flavor source 132 may be a formed body in which the tobacco raw material is formed into a sheet. Moreover, the raw material pieces included in the flavor source 132 may be constituted by a plant other than tobacco (for example, mint and herbs). Flavorings such as menthol may be added to the flavor source 132.

Here, for example, the raw material pieces included in the flavor source 132 are obtained, for example, by sieving that complies with JIS Z 8815 using a stainless steel sieve that complies with JIS Z 8801. For example, raw material pieces passing through a stainless steel sieve having sieve openings of 0.71 mm are obtained by sieving the raw material pieces over 20 minutes by a drying and mechanical shaking method using the stainless steel sieve having the sieve openings of 0.71 mm. Subsequently, raw material pieces passing through a stainless steel sieve having sieve openings of 0.212 mm are removed by sieving the raw material pieces over 20 minutes by the drying and mechanical shaking method using the stainless steel sieve having the sieve openings of 0.212 mm. That is, the raw material pieces included in the flavor source 132 are raw material pieces passing through a stainless steel sieve (sieve openings=0.71 mm) that regulates an upper limit and do not pass through a stainless steel sieve (sieve openings=0.212 mm) that regulates a lower limit. Accordingly, in the embodiment, the lower limit of the size of the raw material pieces included in the flavor source 132 is defined by the sieve openings of a stainless steel sieve that regulates the lower limit. It is noted that the upper limit of the size of the raw material pieces included in the flavor source 132 is defined by the sieve openings of a stainless steel sieve that regulates the upper limit.

In the first embodiment, the flavor source 132 is a tobacco source having an alkaline pH. The pH of the tobacco source is preferably more than 7, and more preferably 8 or above. By increasing the pH beyond 7, the inhaling flavor component generated from the tobacco source can be taken effectively by aerosol. As a result, the amount of the tobacco source can be controlled when imparting a desired amount of the inhaling flavor component to the aerosol. On the other hand, the pH of the tobacco source is preferably 12 or less, and more preferably 10 or less. By keeping the pH at 12 or less, the damage (such as corrosion) to the flavor inhaler 100 (for example, the cartridge 130 or the inhaler main unit 110) can be suppressed more effectively.

It should be noted that the inhaling flavor component generated from the flavor source 132 is transported by the aerosol, and that there is no need of heating the flavor source 132 itself.

The mesh 133A is provided to close the opening of the cartridge main unit 131 at the non-mouthpiece side with respect to the flavor source 132, and the filter 133B is provided to cover the opening of the cartridge main unit 131 at the mouthpiece side with respect to the flavor source 132. The mesh 133A is so rough that the raw material pieces included in the flavor source 132 do not pass through. The roughness of the mesh 133A includes openings from 0.077 mm to 0.198 mm, for example. The filter 133B is constituted by a material having air permeability. The filter 133B is preferably an acetate filter, for example. The filter 133B is so rough that the raw material pieces included in the flavor source 132 do not pass through.

(Block Configuration)

Figure 3:
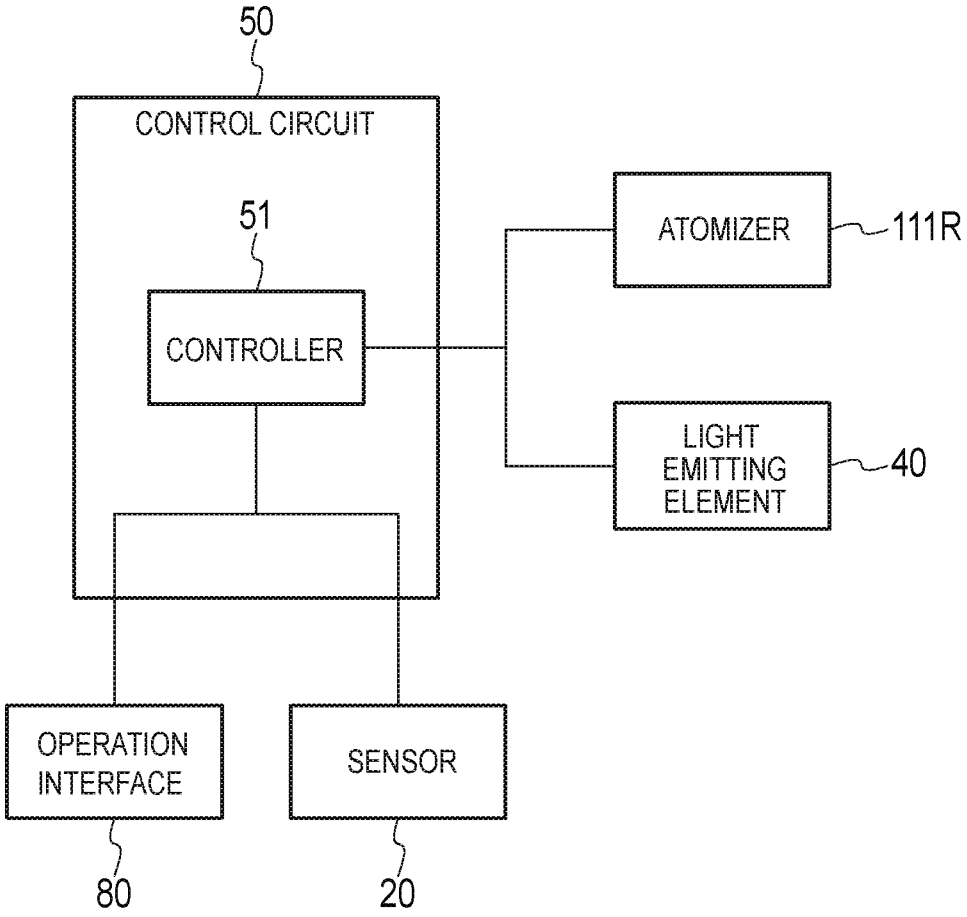
FIG. 3 is a diagram illustrating a block configuration of the non-burning type flavor inhaler 100 according to the first embodiment.

The block configuration of a non-burning type flavor inhaler according to the first embodiment will be described below. FIG. 3 is a diagram illustrating a block configuration of the non-burning type flavor inhaler 100 according to the first embodiment.

As illustrated in FIG. 3, the control circuit 50 has a controller 51. The controller 51 is connected to the sensor 20 and an operation interface 80, and is also connected to the atomizer 111R and the light emitting element 40. The operation interface 80 is an interface for switching a mode for controlling the power supply to the atomizer 111R by a user operation. In the first embodiment, the operation interface 80 is the push button 30.

Firstly, the controller 51 is configured to control the power supply to the atomizer 111R in a mode selected from among a plurality of modes. In the first embodiment, the controller 51 identifies whether or not a puff action is performed depending on a response value output from the sensor 20. The controller 51 supplies power to the atomizer 111R in a puffing state, and does not supply power to the atomizer 111R in a non-puffing state in which the puff action is not performed.

The plurality of modes include a plurality of operation modes that the atomizer 111R generates the aerosol, and a restriction mode that restricting the drive of the atomizer 111R and defined separately from the plurality of operation modes.

Figure 4:
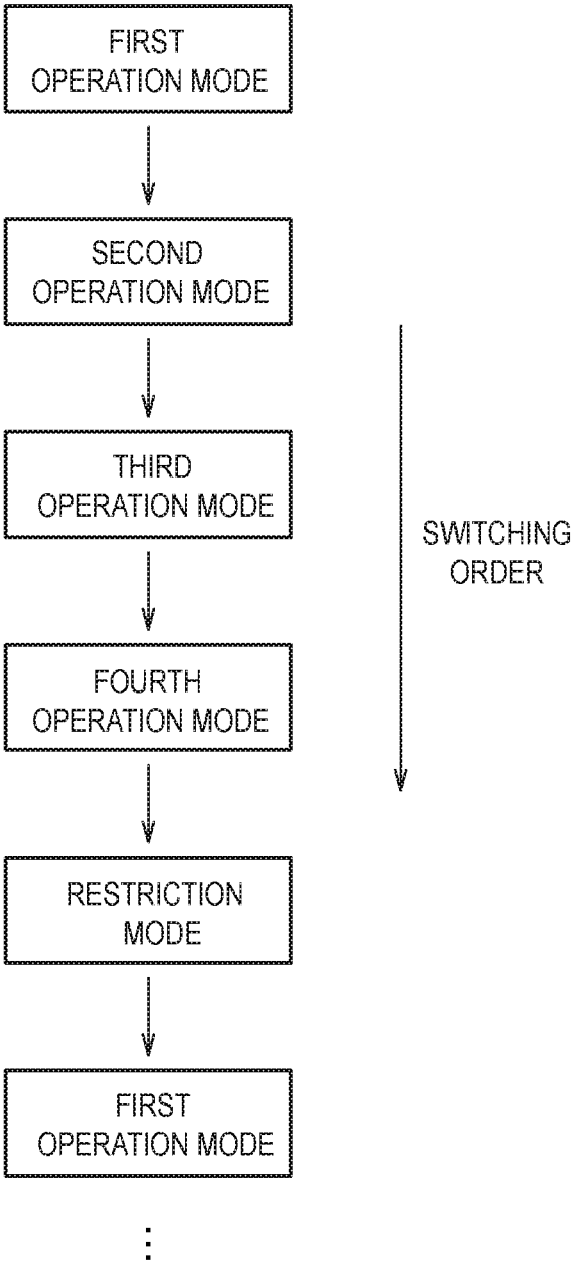
FIG. 4 is a diagram for explaining a mode switching according to the first embodiment.

The plurality of operation modes are modes for enabling the user to inhale the aerosol, and the amount of the aerosol generated from the atomizer 111R in each operation mode is different from each other. The plurality of operation modes are preferably switched in an order in accordance with a predetermined switching order. For example, as illustrated in FIG. 4, when there are four operation modes as the operation modes, the switching order is specified as the first operation mode→the second operation mode→the third operation mode→the fourth operation mode→the restriction mode. In such a case, the index indicating the amount of the aerosol generated from the atomizer 111R preferably has a difference of a certain value or more from each other between two operation modes adjacent in the switching order.

Here, the switching order of each mode is preferably specified so that the index indicating the amount of the aerosol in modes mutually adjacent in the switching order is as large as possible. For example, a case is assumed where the operation mode A, the operation mode B, the operation mode C, and the operation mode D are set in a descending order of the index indicating the amount of the aerosol. In such a case, the switching order is preferably the operation mode C→the operation mode A→the operation mode D→the operation mode B→the restriction mode. Alternatively, the switching order is preferably the operation mode B→the operation mode D→the operation mode A→the operation mode C→the restriction mode. Thus, the switching order is preferably specified so that the switching order of the operation modes having adjacent indexes is not continuous when the operation modes are arranged in an increasing order (or ascending order) of the index indicating the amount of the aerosol. It is noted that when the switching order of the operation modes having adjacent indexes have to be continuous, the switching order is preferably specified so that the restriction mode is placed in between such operation modes.

The index may be a total amount of aerosol generated from the atomizer 111R in a puff action series which is a series of puff actions repeated by a predetermined number. In such a case, the total amount of the aerosol has a difference of 2.0 mg or more from each other between two operation modes adjacent in the switching order. As a result, when the operation mode applied to the atomizer 111R is switched, the user can easily perceive the difference in the amount of the aerosol.

It is noted that when each operation mode is selected, the total amount of the aerosol generated by a series of puff actions repeated by a predetermined number, that is, the total amount of the aerosol can be measured by using a measurement means of the amount of the aerosol used in the general cigarettes. Specifically, the amount of the aerosol can be measured by using a method conforming to an international standard method for tobacco smoking devices known as an ISO method. In the present invention, when measuring the amount of the aerosol by the method, the measurement was performed by specifying the predetermined number of puff actions as seven. More specifically, a series of operations were repeated seven times in which after performing a 35-ml puff action over two seconds in a state in which a Cambridge filter had been arranged at the mouthpiece end of the non-burning type flavor inhaler of the present invention, a 58-second interval (the standby time when a puff action was not performed) was maintained. Thereafter, the total amount of the aerosol was measured by performing quantitative analysis of the components collected in the Cambridge filter. The total amount of the aerosol in each operation mode was measured by performing the analysis under similar conditions in each operation mode. It is noted that the tobacco smoking conditions specified in the above international standard method and the more specific analysis methods are described in more detail in WO2007010407 (HARTMANN DIDIER et al.)

Alternatively, the index may be a standard amount of aerosol generated from the atomizer 111R in a single puff action. In such a case, the total amount of the standard aerosol has a difference of 0.3 mg or more from each other between two operation modes adjacent in the switching order. As a result, when the operation mode applied to the atomizer 111R is switched, the user can easily perceive the difference in the amount of the aerosol.

The amount of the aerosol in a single puff action was measured by replacing the seven-time repeated operations with one-time operation under the above-described conditions for measuring the total amount of the aerosol. Alternatively, the total amount of the aerosol may be determined arithmetically by dividing the total amount obtained under the above-described conditions for measurement by 7 which is the number of repeated operations. As is also clear from the measurement conditions, as long as the action conditions of the non-burning type flavor inhaler do not change excessively, the standard amount of aerosol is 1/7 of the total amount of the aerosol. That is, as long as the action conditions satisfy the above conditions, the difference of 0.3 mg or more in the standard amount of the aerosol is a larger difference than the difference of 2.0 mg in the total amount of aerosol (because 2.0 mg/7<0.3).

Alternatively, the index may be an aerosol amount per unit time that is the amount of the aerosol generated from the atomizer 111R in a unit time since a smoking action is performed. In such a case, the aerosol amount per unit time has a difference of 0.15 mg or more from each other between two operation modes adjacent in the switching order. As a result, when the operation mode applied to the atomizer 111R is switched, the user can easily perceive the difference in the amount of the aerosol.

The aerosol amount per unit time was measured by replacing the puff action of inhaling 35 ml over two seconds with an action of inhaling 17.5 ml over one second in the above-described measurement conditions of the amount of aerosol in a single puff action. It is noted that when the peak is weak (the detected amount is small) during the quantitative analysis of the aerosol amount, the accuracy of the quantitative analysis can be improved by, after performing the above operation a plurality of times, dividing the amount by the number of times. As is also clear from the measurement conditions, as long as the action conditions of the non-burning type flavor inhaler do not change excessively, the aerosol amount per unit time is 1/2 of the standard amount of the aerosol. That is, as long as the action conditions satisfy the above conditions, the difference of 0.15 mg/sec. in the aerosol amount per unit time is equal to the difference of 0.3 mg or more in the standard amount of the aerosol.

The amount of the aerosol indicated by each index can be, for example, controlled by various methods such as the permissible number of continuous puff actions, a maximum energizing time to a heating resistor when the inhaling sensor detects inhaling, a heating temperature of the heating resistor, a material type constituting the heating resistor, intentional changes in power depending on the accumulated number of puff actions, and duty control of power.

The restriction mode may be a mode for restricting the drive of the atomizer 111R. Therefore, the restriction mode may be a mode for stopping the power supply to the atomizer 111R. Alternatively, the restriction mode may be a mode for stopping the power supply to the sensor 20. It should be noted that when the power supply to the sensor 20 is thus stopped, the power supply to the atomizer 111R also stops. By assuming the restriction mode as a mode for stopping the power supply to the atomizer 111R, or as a mode for stopping the power supply to the sensor 20, the generation of the aerosol can be stopped. Therefore, the difference in modes from the other operation modes can be perceived more clearly by the user. In more particular, since the user can perceive the above difference more clearly, it becomes easy to make the user intuitively know that the operation interface 80 is an interface for controlling the amount of the aerosol.

Alternatively, the restriction mode is a mode in which power is supplied to the atomizer 111R, but the amount of power supplied to the atomizer 111R in the restriction mode is preferably a value smaller than a predetermined value (a value at which an aerosol amount smaller than the level perceived by the user is generated). Specifically, for example, power may be supplied so that the heating resistor is heated below 100° C. When heated below 100° C., it is possible to suppress the generation of the aerosol at a level substantively perceived by the user. Moreover, by heating below 100° C., it is possible to easily bring the temperature of the heating resistor close to the desired value when the operation mode is selected again. That is, it is possible to perform preheating. In addition, by heating below 100° C., generation of a slight amount of the aerosol due to the rapid condensation of the residual gases near the heating resistor that can occur during the rapid cooling of the heating resistor heated in the operation mode can be suppressed. It is noted that heating below 100° C. may be ended after a predetermined time. By ending heating after a predetermined time, the standby power can be reduced while suppressing the above-described condensation of gases.

However, it should be noted that the restriction mode is not a state in which the power source of the entire non-burning type flavor inhaler 100 is disconnected. For example, in the restriction mode, the power supply to the light emitting element 40 or the control circuit 50 continues (it is in an energizing state).

In the first embodiment, the controller 51 switches the mode for controlling the power supply to the atomizer 111R in response to a user operation on the operation interface 80. The user operation includes a first operation for switching between two operation modes included in the plurality of operation modes, and a second operation for switching between any one of the plurality of operation modes and the restriction mode. The second operation (for example, switching from the fourth operation mode to the restriction mode, in the example illustrated in FIG. 4) is different from the first operation (for example, switching from the first operation mode to the second operation mode, from the second operation mode to the third operation mode, and from the third operation mode to the fourth operation mode in the example illustrated in FIG. 4). As a result, the user can clearly perceive that the mode has switched to the restriction mode.

Here, when a case where the operation interface 80 is the push button 30 is cited as an example, the user operation is pressing the push button 30. In such a case, the first operation is, for example, the operation pressing the push button 30 for the first time. The second operation is, for example, the operation pressing the push button 30 for a second time longer than the first time. As a result, the user can clearly perceive that the mode has switched to the restriction mode. It is noted that it is but obvious that the first operation and the second operation are different from the operation of continuously pressing the push button 30 over a predetermined number of times (the power ON operation).

In the first embodiment, the controller 51 does not preferably supply power to the atomizer 111R from a timing of selecting any mode from the plurality of modes until the lapse of a certain period, but preferably supplies power to the atomizer 111R after the lapse of the certain period. The certain period is preferred to be a comparatively short period of time. Specifically, the certain period of time is preferably within two seconds, and more preferably within one second. Since the aerosol is no longer generated as a result of switching of the mode, the user can easily perceive that the mode has been switched by mistake (an incorrect action or an incorrect operation). Moreover, due to a rapid change in the action conditions such as power supply to the atomizer 111R in connection with the switching of the mode, the load of the components constituting the non-burning type flavor inhaler 100 can be reduced. The stop of power supply to the atomizer 111R may be a state of stopping power supply to the atomizer 111R without stopping the power supply to the sensor 20. Alternatively, the stop of power supply to the atomizer 111R may be a state of stopping the power supply to the sensor 20.

Secondly, the controller 51 controls the light emitting element 40. Specifically, the controller 51 controls the light emitting state of the light emitting element 40 in at least any one of a mode selection state, a puffing state, and a non-puffing state. The mode selection state is an instantaneous state at a timing of mode switching from one mode to another mode, or a state from a timing until a certain period has elapsed. The puffing state is a state in which a puff action is performed. The non-puffing state is a state in which a puff action is not performed (a standby state between puff actions).

Here, the light emitting state of the light emitting element 40 in the mode selection state is preferably different from the light emitting state immediately before a timing of mode switching from one mode to another mode. The light emitting state immediately before the timing may be a light emitting state of the light emitting element 40 in the puffing state, or may be a light emitting state of the light emitting element 40 in the non-puffing state, or else, may be a light emitting state in which the light emitting element 40 does not emit light (OFF). With such a configuration, it is possible for a user to visually determine whether or not mode switching has been performed, allowing the user to easily perceive that the mode has been switched by mistake (an incorrect action or an incorrect operation). Alternatively, the user can easily check whether or not the mode has been switched. At this time, the certain period may be a comparatively short time, i.e., about one second, or the fixed time may be a time that continues until immediately before the puff action is performed. That is, the mode selection state may include the non-puffing state, or need not include the non-puffing state.

Further, the light emitting state of the light emitting element 40 includes a first light emitting state in the plurality of operation modes, and a second light emitting state in the restriction mode. The second light emitting state is preferably different from the first light emitting state. As a result, the user can easily perceive the restriction mode in at least any one of the mode selection state, the puffing state, and the non-puffing state. Further, the first light emitting state in each operation mode is more preferably different from the others.

For example, the color temperature of the first light emitting state and the color temperature of the second light emitting state is preferably 5500 K or less. A light emitting state in which the color temperature is 5500 K or less is used, for example, as a light emitting state in the puffing state. However, the embodiment is not limited thereto, and a light emitting state in which the color temperature is 5500 K or less may also be used as a light emitting state in the mode selection state, or the non-puffing state.

Further, the color temperature of the light emitting state in each mode is 5500 K or less each, and is preferably different from each other. In such a case, the color temperature of the light emitting state in each mode is preferably different by 200 K or more from each other. The color temperature of the light emitting state in each mode preferably becomes smaller as the amount of aerosol in each mode increases. Any one of the total amount of the aerosol, the standard amount of the aerosol, and the aerosol amount per unit time described above may be used as the index indicating the amount of the aerosol in each mode. With such a configuration, it is possible to apply fixed principles to the relationship between the amount of the aerosol and the color temperature, allowing the user to easily and sensually comprehend the relationship between the color temperature and the aerosol.

Alternatively, as for the color temperature of the first light emitting state and the second light emitting state, a* is preferably a positive value in the Lab color space. A light emitting state in which a* is a positive value in the Lab color space is used, for example, as a light emitting state in the puffing state. However, the embodiment is not limited thereto, and a light emitting state in which a* is a positive value may also be used as a light emitting state in the mode selection state, or the non-puffing state.

Further, the light emitting state in each mode is preferably a state in which a* is a positive value in the Lab color space, and is preferably different from each other. In such a case, the color difference $\Delta E^*ab$ of the light emitting state in each mode is preferably different by 3.0 or more from each other. Preferably, the a* of the light emitting state in each mode becomes more as the amount of aerosol in each mode increases. Any one of the total amount of the aerosol, the standard amount of the aerosol, and the aerosol amount per unit time described above may be used as the index indicating the amount of the aerosol in each mode. With such a configuration, it is possible to apply fixed principles to the relationship between the amount of the aerosol and the color space, allowing the user to easily and sensually comprehend the relationship between the color space and the aerosol.

It is noted that the light emitting state in each of the operation modes and the restriction mode may be different in any one of the mode selection state, the puffing state, and the non-puffing state. However, the light emitting state in each mode may be different in the puffing state, and the light emitting state in each mode may be the same in the mode selection state and the non-puffing state.

In addition, the light emitting state in the mode selection state, the puffing state, and the non-puffing state may be different from each other. For example, the light emitting state in the mode selection state may be blinking of the light emitting element 40, the light emitting state in the puffing state may be lighting of the light emitting element 40, and the color of the light emitting state in the non-puffing state may be different from the color of the light emitting state in the puffing state.

In the first embodiment, as described above, the controller 51 does not preferably supply power to the atomizer 111R from the timing of selecting any mode from the plurality of modes until the lapse of a certain period, that is, in the mode selection state, but preferably supplies power to the atomizer 111R after the lapse of the certain period. In such a case, during the period when the controller 51 stops the power supply to the atomizer 111R, the light emitting element 40 may emit light in a light emitting state different from the light emitting state in the puffing state and the non-puffing state. At this time, the certain period is preferred to be a comparatively short period. Specifically, the certain period is preferably within two seconds, and more preferably within one second.

(Operation and Effect)

In the first embodiment, in addition to the plurality of operation modes, the plurality of operation modes include a restriction mode for restricting the drive of the atomizer 111R. Therefore, by switching the mode for controlling the atomizer 111R to the restriction mode, the user can clearly perceive a reduction in the aerosol, and the user can easily understand whether or not the switching (switching of the mode) of the amount of the aerosol generated from the atomizer 111R functions actually.

[First Modification]

A first modification of the first embodiment will be described below. Description proceeds with a particular focus on a difference from the first embodiment, below.

In the first embodiment, a case where the operation interface 80 configured to switch the mode for controlling the atomizer 111R by a user operation is the push button 30 is illustrated. On the other hand, in the first modification, the operation interface 80 is a ring member 30A configured to be rotatable. The user operation, the user operation for switching the mode is rotating the ring member.

Figure 5:
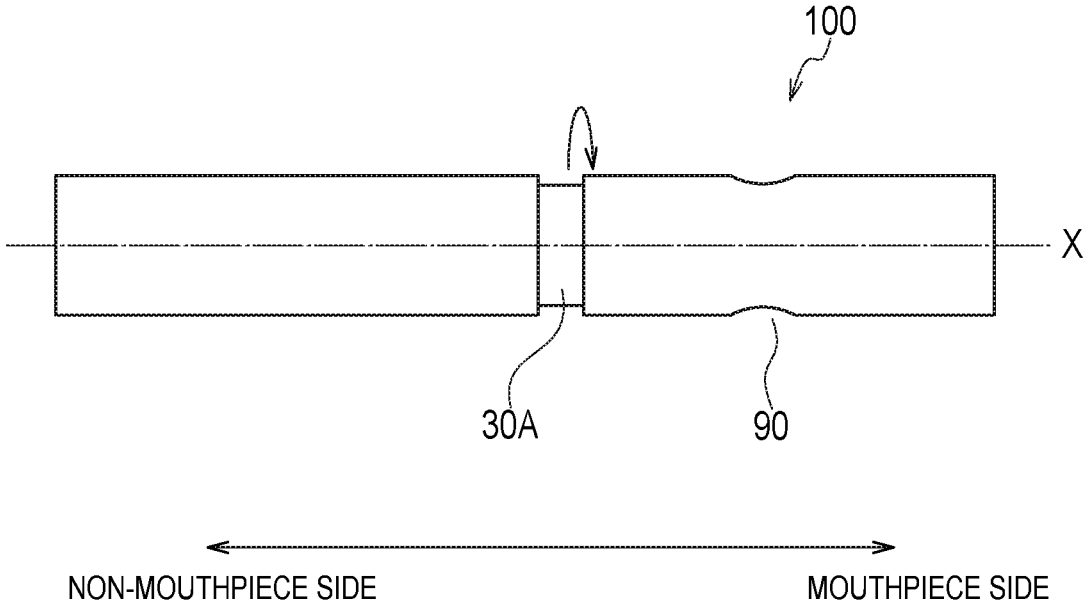
FIG. 5 is a diagram for explaining a ring member 30A according to a first modification.

Specifically, as illustrated in FIG. 5, the ring member 30A is configured to be rotatable around a rotation axis X. Here, the non-burning type flavor inhaler 100 (that is, the inhaler main unit 110) has a handgrip 90 that sinks in toward the inner side of the non-burning type flavor inhaler 100, and the ring member 30A is provided toward the non-mouthpiece side from the handgrip 90. As a result, an undesirable operation of the ring member 30A can be suppressed even when the user holds the non-burning type flavor inhaler 100 by the handgrip 90 during the inhalation.

Figure 6:
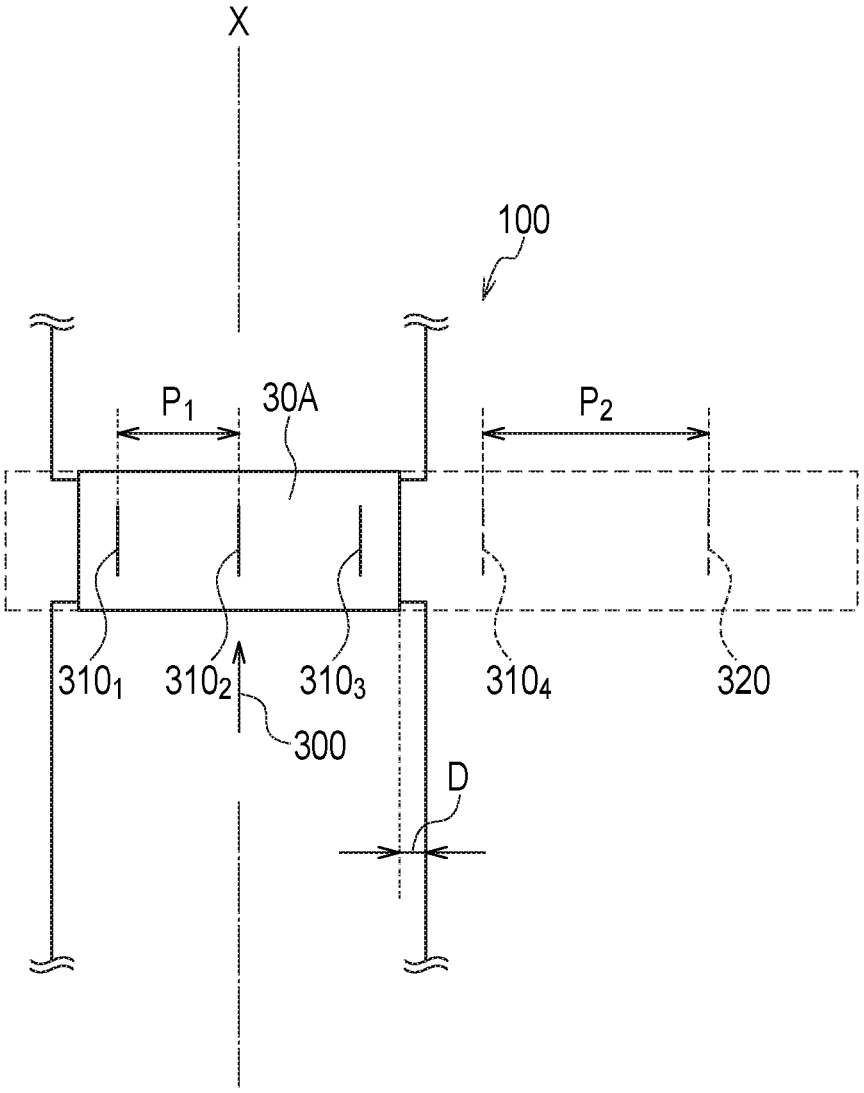
FIG. 6 is a diagram for explaining a ring member 30A according to the first modification.

Here, as illustrated in FIG. 6, an indication mark 300 for indicating the mode applied to the atomizer 111R is provided on a surface of the non-burning type flavor inhaler 100 (that is, the inhaler main unit 110). A mode mark for indicating the position of each mode is provided on the surface of the ring member 30A. The mode mark includes an operation mode mark 310 (an operation mode mark $\mathbf{310}_1$ to an operation mode mark $\mathbf{310}_4$) indicating a plurality of operation modes, and a restriction mode mark 320 indicating the restriction mode. It should be noted that FIG. 6 shows a state in which the ring member 30A has rotated in the rotating axis.

In such a case, an interval $P_2$ between the operation mode mark 310 and the restriction mode mark 320 is smaller than an interval $P_1$ between the mutually adjacent operation mode marks 310. That is, the first operation for performing a switch between two operation modes included in the plurality of operation modes is an operation of the ring member 30A rotating over a first angle, and the second operation for switching between any operation mode of the plurality of operation modes and the restriction mode is an operation of the ring member 30A rotating over a second angle larger than the first angle. As a result, the user can clearly perceive that the mode has switched to the restriction mode.

In the first modification, the ring member 30A preferably sinks in toward the inner side from the non-burning type flavor inhaler 100 (that is, the inhaler main unit 110). When the non-burning type flavor inhaler 100 has a columnar shape, the ring member 30A sinks in toward the inner side by a thickness D with respect to the surface of the non-burning type flavor inhaler 100. It is noted that the ring member 30A may sink in toward the inner side by the thickness D with respect to the surface of the portion having the maximum diameter of the non-burning type flavor inhaler 100. The thickness D is preferably 1 mm or more. As a result, even when the non-burning type flavor inhaler 100 is placed horizontally on a flat surface, the ring member 30A does not come in contact with the flat surface, and thus an incorrect operation on the ring member 30A can be prevented.

In the first modification, the difference between the first operation and the second operation is the angle of rotating the ring member, but the first modification is not restricted thereto. The first operation may be an operation for making the ring member to rotate by a first stress, and the second operation may be an operation for making the ring member rotating by a second stress larger than the first stress. In other words, the ease of rotation (the repulsion force) of the ring member in the second operation for switching between an operation mode and the restriction mode is more than the ease of rotation (the repulsion force) of the ring member in the first operation for performing a switch between two operation modes.

Here, the rotation of the ring member 30A may be a form in which a rotation of 360° around the rotation axis X is permissible. For example, in the example illustrated in FIG. 4, switching from the restriction mode to the first operation mode is permissible. Alternatively, the rotation of the ring member 30A may be a form in which only a fixed angle of rotation is permissible, and a rotation of 360° around the rotation axis X is not permissible. For example, in the example illustrated in FIG. 4, switching from the restriction mode to the first operation mode is not permissible, but switching from the restriction mode to the fourth operation mode, switching from the fourth mode to the third mode, and the like is permissible.

Other Embodiments

The present invention is explained through the above-described embodiment, but it must not be understood that this invention is limited to the statements and the drawings constituting a part of this disclosure. From this disclosure, various alternative embodiments, examples, and operational technologies will be obvious to those skilled in the art.

In the embodiment, the controller 51 identifies whether or not a puff action is performed depending on a response value output from the sensor 20. The controller 51 supplies power to the atomizer 111R in a puffing state, and does not supply power to the atomizer 111R in a non-puffing state in which the puff action is not performed. However, the embodiment is not limited thereto. The non-burning type flavor inhaler 100 may have an inhalation button instead of the sensor 20 (hereinafter, also called the tank type). The controller 51 may supply power to the atomizer 111R during the period when the inhalation button is being operated (for example, pressed). It is noted that the controller 51 does not supply power to the atomizer 111R during the period when the inhalation button is not being operated (for example, pressed). In such a case, the state in which the inhalation button is being operated is the puff action in which the puff action is being performed, and the state in which the inhalation button is not being operated is the non-puff action in which the puff action is not being performed.

In the above-described tank type of the non-burning type flavor inhaler 100, the operation interface configured to switch the mode is preferably provided separately from the inhalation button described above. However, the inhalation button described above may constitute an operation interface configured to switch the mode. In such a case, the mode may be switched in accordance with the number of times the inhalation button is pressed within a predetermined time, the time duration of pressing, the pressing pressure, or the like. It should be noted that in the quantitative analysis of the amount of the aerosol, the above-described puff action for two seconds is replaced by pressing the inhalation button for two seconds.

In the embodiment, the push button 30 and the ring member 30A are illustrated as the operation interface 80 configured to switch the mode by a user operation. However, the embodiment is not limited thereto. For example, the non-burning type flavor inhaler 100 may have a connector configured to connect the electrical unit 112 and the atomizing unit 111, and the connector may constitute a means that switches the mode. The connector is, for example, constituted by a connector provided in the electrical unit 112 and a connector provided in the atomizing unit 111. Each of the connectors constitutes an electrical contact between the electrical unit 112 and the atomizing unit 111. When the electrical unit 112 and the atomizing unit 111 are connected by a screw connection, each of the connectors is a male connector having a spiral projection and a female connector having a spiral groove. Each of the connectors has a plurality of stages of electrical contacts, and the mode is specified depending on the number of contacts connected electrically. For example, the atomizing unit 111 has a plurality of heating resistors (heating wires) provided for each of the plurality of stages of the electrical contact, and the number of the electrically-connected contacts (that is, the heating resistors to which power is supplied) may change depending on the degree (depth) of connection of the above-described connectors. The mode is switched as a result of a change in the number of heating resistors to which power is supplied.

In the embodiment, a case where a plurality of modes include one restriction mode is illustrated when the switching order of the modes is specified beforehand. However, the embodiment is not limited thereto. A plurality of modes may include two or more restriction modes. For example, when it is not possible to arrange two operation modes adjacent in the switching order so that the index indicating the amount of the aerosol generated from the atomizer 111R has a difference of a certain value or more from each other, a restriction mode is preferably arranged between such operation modes. As a result, the user can clearly perceive a change in the aerosol, and the user can easily understand whether or not the switching (switching of the mode) of the amount of the aerosol generated from the atomizer 111R actually functions.

In the embodiment, the push button 30 and the ring member 30A are illustrated as the operation interface 80 configured to switch the mode for controlling the atomizer 111R by a user operation. However, the embodiment is not limited thereto. The operation interface 80 may be an interface configured to switch the mode by sliding a member. In such a case, the second operation for switching between an operation mode and the restriction mode is desired to be different from the first operation for switching between two operation modes.

In the embodiment, when the push button 30 is pushed continuously over a predetermined number of times, the non-burning type flavor inhaler 100 is turned ON. However, the embodiment is not limited thereto. For example, the non-burning type flavor inhaler 100 may be turned ON by the electrical connection between the electrical unit 112 and the atomizing unit 111. The non-burning type flavor inhaler 100 may be turned OFF by the electrical disconnection between the electrical unit 112 and the atomizing unit 111.

In the embodiment, the cartridge 130 (the flavor source 132) is provided at the mouthpiece side of the atomizing unit 111. However, the embodiment is not limited thereto. For example, the non-burning type flavor inhaler 100 need not have the cartridge 130 (the flavor source 132). In such a case, the aerosol source preferably contains a flavor component. The flavor component contained in the aerosol source is optional.

EXAMPLE

An example is used below to describe the embodiment of the present invention in more detail.

A device was created to achieve a plurality of modes with different drive voltages by using a modification of a commercially available e-cigarette VUSE (manufactured by RJR). Specifically, an electrode connected electrically to the coil of the e-cigarette and a power source stored inside the e-cigarette main unit were electrically disconnected, while a power source from which power could be input freely and a terminal of the electrode was connected electrically by an electric wire. With the help of such a method, a device in which the total amount of the aerosol could be changed was prepared. The total amount of the aerosol was changed by appropriately changing the power or the power supply time.

It is noted that the total amount of the aerosol was measured by using a method conforming to an international standard method for tobacco smoking devices known as an ISO method as a method for calculating the total amount of the aerosol. More specifically, a series of operations were repeated seven times in which after performing a 35-ml puff action over two seconds in a state in which a Cambridge filter had been arranged at the mouthpiece end of the non-burning type flavor inhaler thus prepared, a 58-second interval (the standby time when a puff action was not performed) was maintained. Thereafter, the total amount of the aerosol was measured by performing quantitative analysis of the components collected in the Cambridge filter.

50 in-house subjects, who met the conditions as tobacco smokers and who were willing to inhale the non-burning type flavor inhaler were asked to smoke freely by using the device described above, and it was verified whether or not a change in the amount of the aerosol could be perceived when the total amount of the aerosol was changed from a certain amount to a different amount. Specifically, it was verified whether or not a change in the total amount of the aerosol could be perceived when changing from the drive condition of the total amount of aerosol illustrated in "Before change" in Table 1 to the drive condition of the total amount of aerosol illustrated in "After change" in Table 1. The experiment conditions and results are illustrated together in Table 1.

TABLE 1

| total aerosol amount | | |
|---|---|---|
| before change (mg) | after change (mg) | no. of those who perceived change (out of 50) |
| 1 | 2 | 22 |
| 1 | 3 | 39 |
| 1 | 4 | 46 |
| 3 | 4 | 23 |
| 3 | 5 | 40 |
| 5 | 6 | 20 |
| 5 | 7 | 41 |
| 5 | 8 | 47 |
| 8 | 9 | 22 |
| 8 | 10 | 41 |

As is clear from above, by setting the change in the total amount of the aerosol between operation modes to 2.0 mg or more, the change between the modes can be more clearly perceived by the user.

INDUSTRIAL APPLICABILITY

According to the embodiment, an object of the present invention is to provide a non-burning type flavor inhaler by which a user can easily understand whether or not a switch in the amount of the aerosol generated from the atomizer actually functions.

The invention claimed is:

1. A non-burning type flavor inhaler comprising:

an atomizer configured to atomize an aerosol source without burning;

a power source configured to accumulate power to be supplied to the atomizer; and a controller configured to control a power supply to the atomizer in a mode selected from among a plurality of modes, wherein the plurality of nodes include a plurality of operation modes wherein the atomizer generates an aerosol, and a restriction mode wherein drive of the atomizer is restricted, wherein each operation mode has a total amount of aerosol indicating an amount of the aerosol generated from the atomizer in a puff action series which is a series of puff actions repeated by a predetermined number, and a difference between the total amount of aerosol of two operation modes in the plurality of operation modes is at least 2.0 mg.

2. A non-burning type flavor inhaler comprising:

an atomizer configured to atomize an aerosol source without burning;

a power source configured to accumulate power to be supplied to the atomizer; and a controller configured to control a power supply to the atomizer in a mode selected from among a plurality of modes, wherein the plurality of modes include a plurality of operation modes wherein the atomizer generates an aerosol, and a restriction mode wherein drive of the atomizer is restricted, wherein each operation mode has a standard amount of aerosol indicating an amount of the aerosol generated from the atomizer in a single puff action, and wherein the standard amounts of aerosol of two operation modes in the plurality of modes have a difference of at least 0.3 mg.

3. A non-burning type flavor inhaler comprising:

an atomizer configured to atomize an aerosol source without burning;

a power source configured to accumulate power to be supplied to the atomizer; and a controller configured to control a power supply to the atomizer in a mode selected from among a plurality of modes, wherein the plurality of modes include a plurality of operation modes wherein the atomizer generates an aerosol, and a restriction mode wherein drive of the atomizer is restricted, wherein each operation mode has an aerosol amount per unit time indicating an amount of the aerosol generated from the atomizer in a unit time, wherein a difference between the aerosol amount per unit time of two operation modes in the plurality of operation modes is at least 0.15 mg/sec.

4. The non-burning type flavor inhaler according to claim 1, comprising:

a light emitting element configured to emit light in a mode selection state, wherein the mode selection state is an instantaneous state at a timing of mode switching from one mode to another mode, or a state from the timing until a certain period has elapsed, and a light emitting state of the light emitting element in the mode selection state is different from a light emitting state of the light emitting element immediately before the timing.

5. The non-burning type flavor inhaler according to claim 1, comprising:

an operation interface configured to switch a mode for controlling the power supply to the atomizer by a user operation, wherein the operation interface is constituted by a push button, and the user operation is pressing the push button.

6. The non-burning type flavor inhaler according to claim 1, wherein the controller does not supply power to the atomizer from a timing of selecting any mode from the plurality of modes until the lapse of a certain period, but supplies power to the atomizer after the lapse of the certain period.

7. The non-burning type flavor inhaler according to claim 1, comprising:

a sensor configured to output a response value that changes in accordance with air inhaled from a non-mouthpiece end toward a mouthpiece end, wherein the controller identities whether or not a puff action is performed based on the response value.

8. The non-burning type flavor inhaler according to claim 1, wherein the plurality of operation modes are switched in an order in accordance with a predetermined switching order, and wherein the two operation modes are adjacent in the predetermined switching order.

* * * * *